US006984155B1

(12) United States Patent
Liu

(10) Patent No.: US 6,984,155 B1
(45) Date of Patent: Jan. 10, 2006

(54) RJ-45 SOCKET

(75) Inventor: Lu-Ta Liu, Taipei (TW)

(73) Assignee: Lankom Electronics Co., LTD, Taipei (TW)

( * ) Notice: Subject to any disclaimer, the term of this patent is extended or adjusted under 35 U.S.C. 154(b) by 0 days.

(21) Appl. No.: 11/116,923

(22) Filed: Apr. 28, 2005

(51) Int. Cl.
*H01R 24/00* (2006.01)

(52) U.S. Cl. ..... 439/676; 439/490

(58) Field of Classification Search ..... 439/676, 439/620, 490, 680
See application file for complete search history.

(56) References Cited

U.S. PATENT DOCUMENTS 6,354,884 B1 * 3/2002 Yeh et al. ..... 439/680
6,457,993 B1 * 10/2002 Espenshade ..... 439/490
6,511,348 B1 * 1/2003 Wojtacki et al. ..... 439/620
6,537,110 B1 * 3/2003 Korsunsky et al. ..... 439/676
6,699,065 B1 * 3/2004 Espenshade et al. ..... 439/490
6,749,467 B2 * 6/2004 Korsunsky et al. ..... 439/676
2003/0100217 A1 * 5/2003 Wu ..... 439/490

* cited by examiner

*Primary Examiner*—Tulsidas C. Patel
*Assistant Examiner*—Vladimir Imas
(74) *Attorney, Agent, or Firm*—Dellett & Walters

(57) ABSTRACT

An RJ-45 socket has a base, a circuit board, a casing and a cover. The base has multiple leads extending through the base. The circuit board is mounted on the base and has multiple lead contacts, multiple electrical contacts and a circuit. The lead contacts are formed in the circuit board and connect respectively to the corresponding leads in the base. The electrical contacts are formed in the circuit board. The circuit is formed in the circuit board. The casing is mounted on the base above the circuit board and has a cavity and a contact assembly. The contact assembly has multiple contacts mounted in the socket. The contacts are connected respectively to the corresponding leads because the circuit in the circuit board electrically connects the electrical contacts respectively to the corresponding lead contacts.

6 Claims, 6 Drawing Sheets

RJ-45 SOCKET

BACKGROUND OF THE INVENTION

1. Field of the Invention

The present invention relates to a socket, especially to an RJ-45 socket.

2. Description of the Prior Arts

RJ-45 sockets are mounted in ports or interfaces in electrical appliances such as computers to connect signals transported electric wires to the appliance. The conventional RJ-45 socket comprises a base, a circuit board, a casing, a contact assembly and a cover. The circuit board is mounted on the base and has multiple electrical contacts and multiple leads extending through the base to connect to another circuit board in the electrical appliance. The casing is mounted on the base and has a cavity. The contact assembly is mounted in the cavity and has multiple contacts. The contacts correspond respectively to the electrical contacts on the circuit board, and each contact has a lead to connect to the corresponding electrical contact. The cover is mounted on and covers the casing, the circuit board and the base.

Because the distance between adjacent contacts of the contact assembly is very short, the connection has to be very precise when the leads of the contacts of the contact assembly are connected to the corresponding electrical contacts. Therefore the connection is complicated and time-consuming.

The conventional RJ-45 socket further has two light-emitting diodes (LEDs). The casing has two sides and a top. The LEDs are mounted in the top of the casing respectively near the sides, and each LED has two leads. The leads of the LEDs extend through the base to connect to the circuit board in the electrical appliance. The circuit board in the electrical appliance has four contacts corresponding to the leads from the LEDs. However, the contacts on the circuit board may not align precisely with the corresponding leads of the LEDs. Therefore, the leads from the LEDs may have to be bent to connect to the corresponding contacts on the circuit board. The bent leads easily interfere with other wires connecting to the circuit board.

To overcome the shortcomings, the present invention provides an improved RJ-45 socket to mitigate or obviate the aforementioned problems.

SUMMARY OF THE INVENTION

The main objective of the present invention is to provide an RJ-45 socket that has a circuit board with a circuit. The RJ-45 socket has a base, a circuit board, a casing and a cover. The base has multiple leads extending through the base. The circuit board is mounted on the base and has multiple lead contacts, multiple electrical contacts and a circuit. The lead contacts are formed separately in the circuit board and connect respectively to the corresponding leads in the base. The electrical contacts are formed in the circuit board. The circuit is formed in the circuit board, and the electrical contacts electrically connect respectively to the lead contacts. The casing is mounted on the base above the circuit board and has a cavity and a contact assembly. The contact assembly has multiple contacts mounted in the cavity. The contacts are connected simply to the corresponding leads because the circuit in the circuit board connects the electrical contacts electrically to the corresponding lead contacts.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
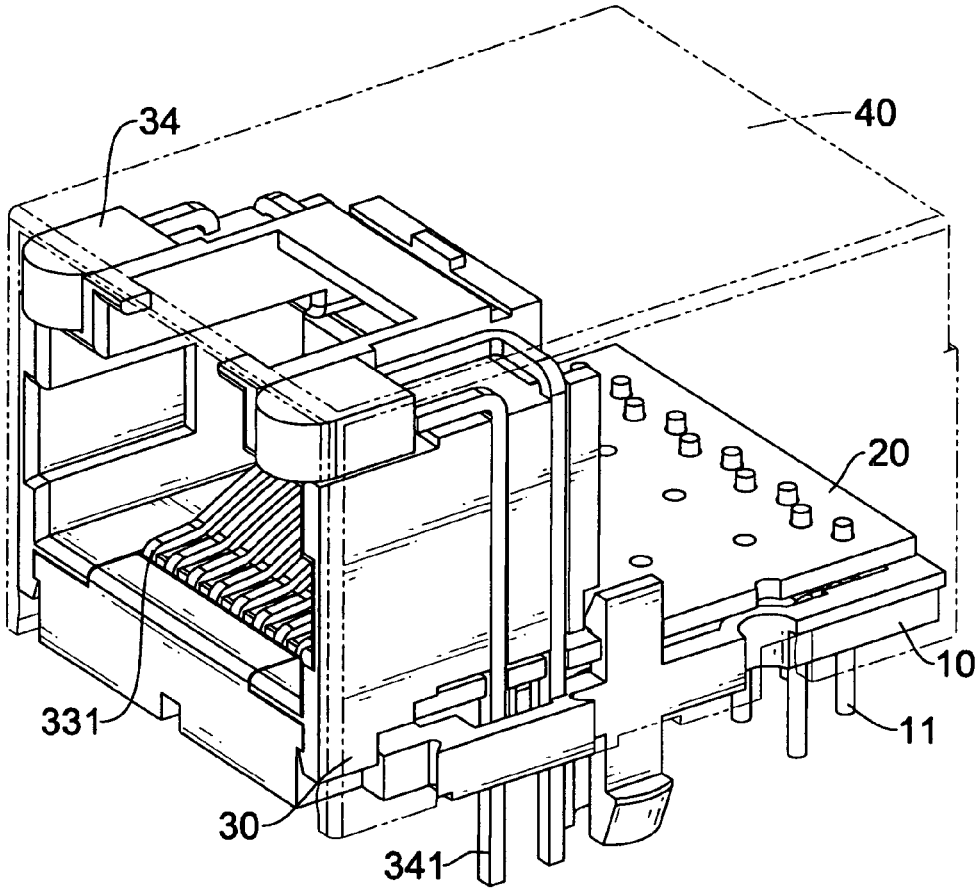
FIG. 1 is an enlarged perspective view of an RJ-45 socket in accordance with the present invention.
Figure 2:
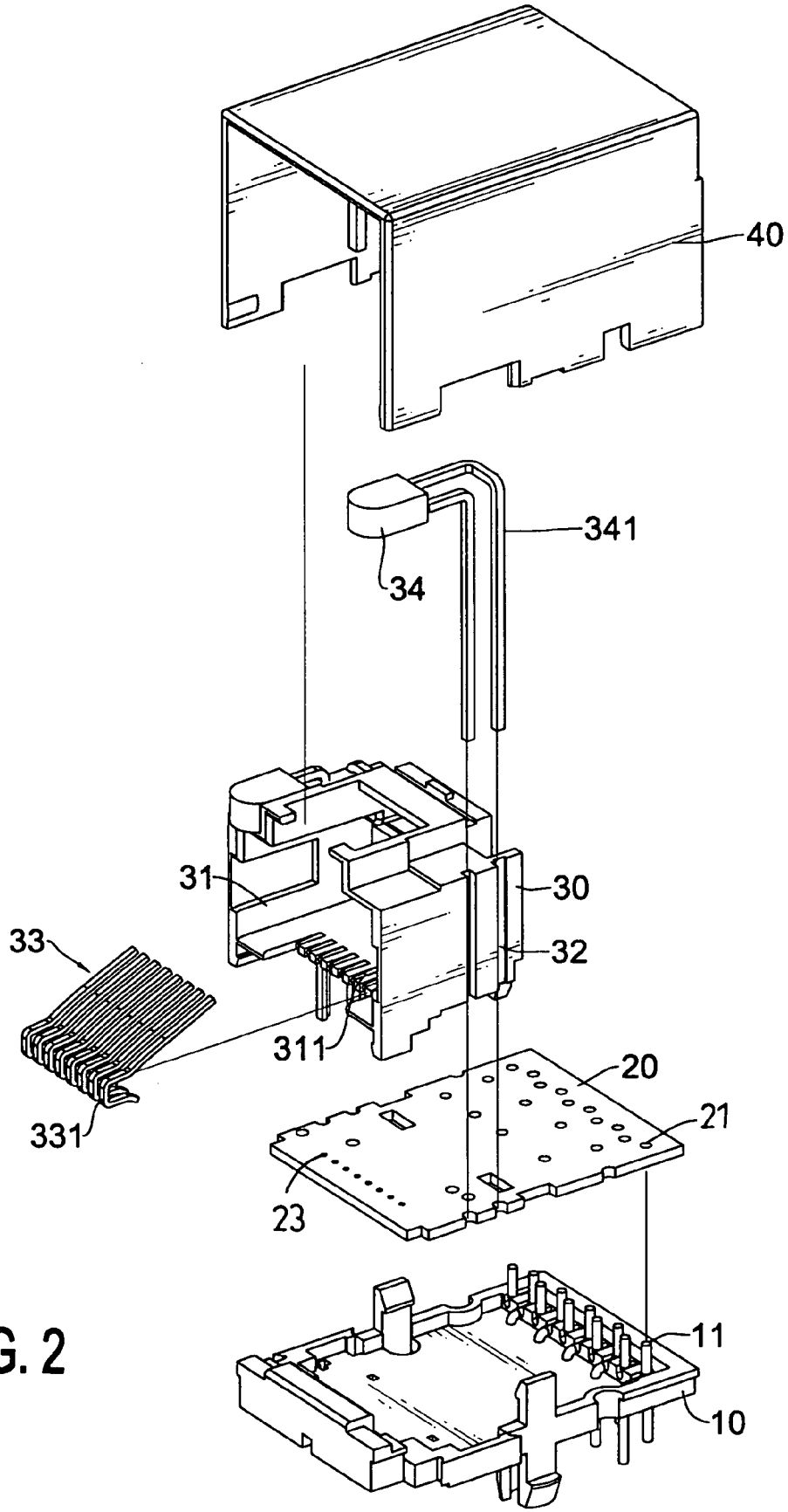
FIG. 2 is an exploded perspective view of the RJ-45 socket in FIG. 1.

With reference to FIGS. 1 and 2, an RJ-45 socket in accordance with the present invention comprises a base (10), a circuit board (20), a casing (30) and a cover (40).

The base (10) has a top surface, multiple leads (11) and a rear end. The leads (11) extend through the base (10) and may extend through the base (10) near the rear end of the base (10).

With further reference to FIGS. 3–7, the circuit board (20) is mounted on the top surface of the base (10) and has a front end, a rear end, a bottom surface, a top surface, multiple lead contacts (21), multiple electrical contacts (23), four optional top light-emitting diode (LED) contacts (24), four optional bottom LED contacts (25), a circuit and four optional LED extension leads (22). The lead contacts (21) are formed in the circuit board (20), connect respectively to the leads (11) in the base (10) and may be formed near the rear end of the circuit board (20). The electrical contacts (23) are formed in the circuit board (20) and may be formed near the front end of the circuit board (20). The top LED contacts (24) are formed separately on the top surface of the circuit board (20). The bottom LED contacts (25) are formed separately on the bottom of the circuit board (20). The circuit is formed in the circuit board (20) to electrically connect the electrical contacts (23) respectively to the lead contacts (21) and the top LED contacts (24) respectively to the bottom LED contacts (25). The LED extension leads (22) connect respectively to the bottom LED contacts (25) on the circuit board (20) and extend through the base (10).

The casing (30) is mounted on the base (10) above the circuit board (20) and has a front end, a top, a bottom, two sides, a cavity (31), two pairs of slots (32), a contact assembly (33) and two LEDs (34). The cavity (31) is formed in the front end of the casing (30) and has multiple notches (311). The notches (311) are formed in the cavity (31) in the bottom of the casing (30). The pairs of slots (32) are formed respectively in the sides of the casing (30) from the top to the bottom. The contact assembly (33) is mounted in the notches (311) in the cavity (31) and has multiple contacts (331). The contacts (331) are mounted respectively in the notches (311) and correspond to and connect respectively to the electrical contacts (23) in the circuit board (20). The LEDs (34) are mounted on the top of the casing (30) respectively near the sides, and each LED (34) has two leads (341). The leads (341) align respectively with the slots (32) and may extend through the circuit board (20) and the base (10) or may connect respectively to the top LED contacts (24) on the circuit board (20).

The cover (40) is mounted securely on and covers the casing (30), the circuit board (20) and the base (10).

The RJ-45 socket as described has to be electrically connected to the other circuit board and has the following advantages:

1. The leads (11) in the base (10) connect to the other circuit board. The contacts (331) of the contact assembly (33) are electrically connected respectively to the leads (11) to connect to the other circuit board. The contacts (331) are connected simply to the corresponding leads (11) because the circuit in the circuit board (20) electrically connects the electrical contacts (23) respectively to the corresponding lead contacts (21).

Figure 3:
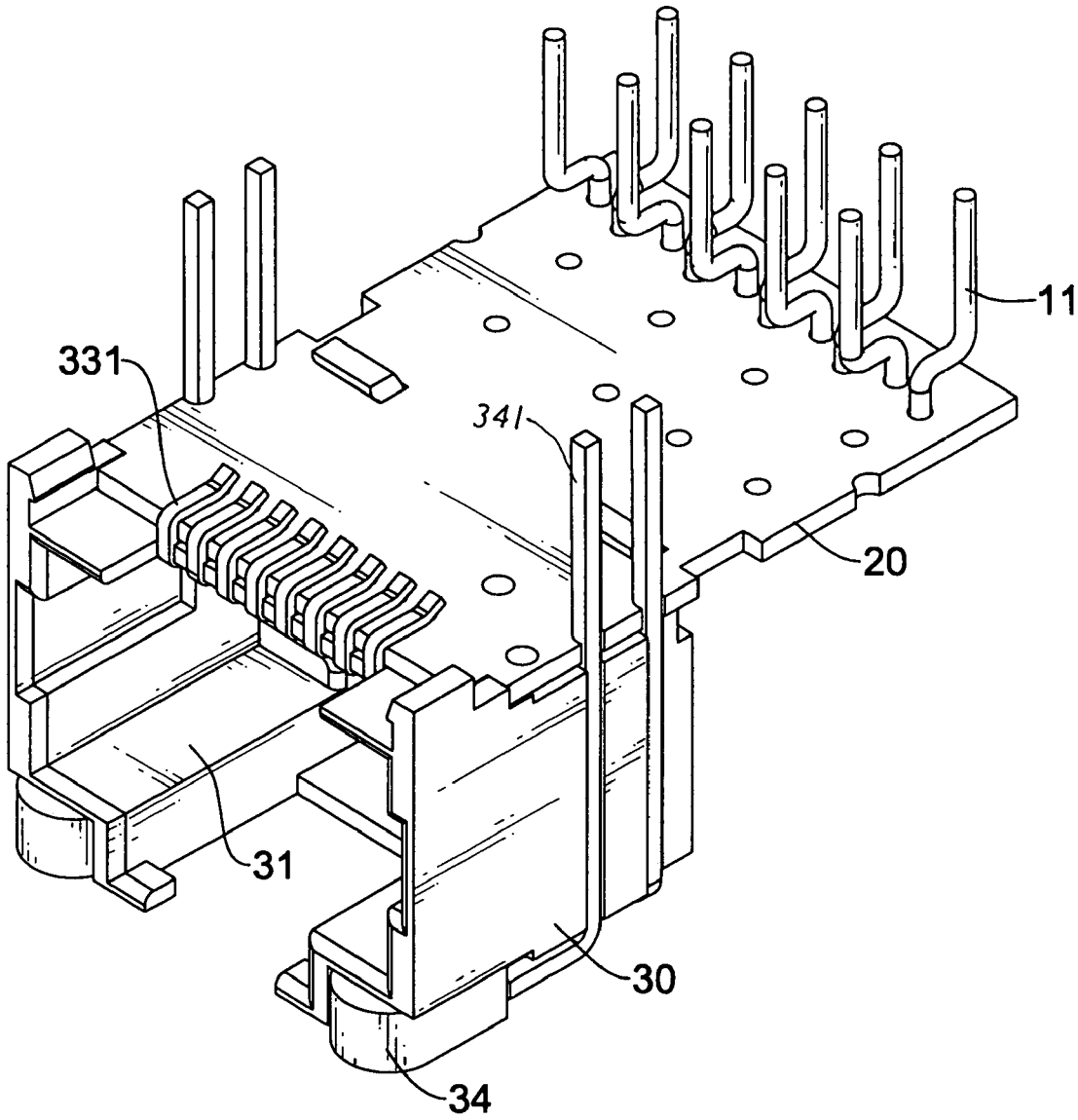
FIG. 3 is a bottom perspective view of the RJ-45 socket in FIG. 1 without a base and a cover.
Figure 4:
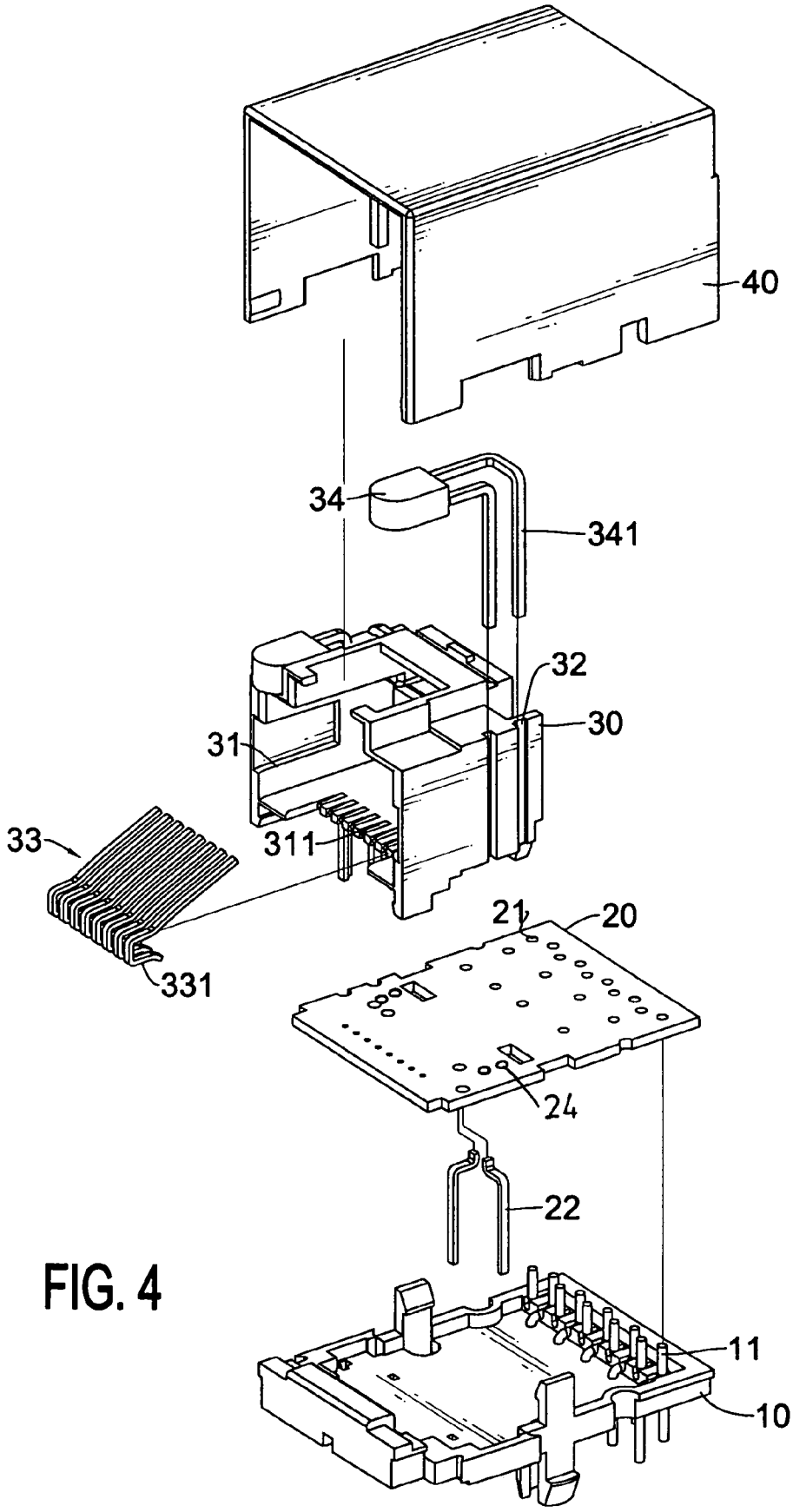
FIG. 4 is an exploded perspective view of another embodiment of a RJ-45 socket in accordance with the present invention.
Figure 5:
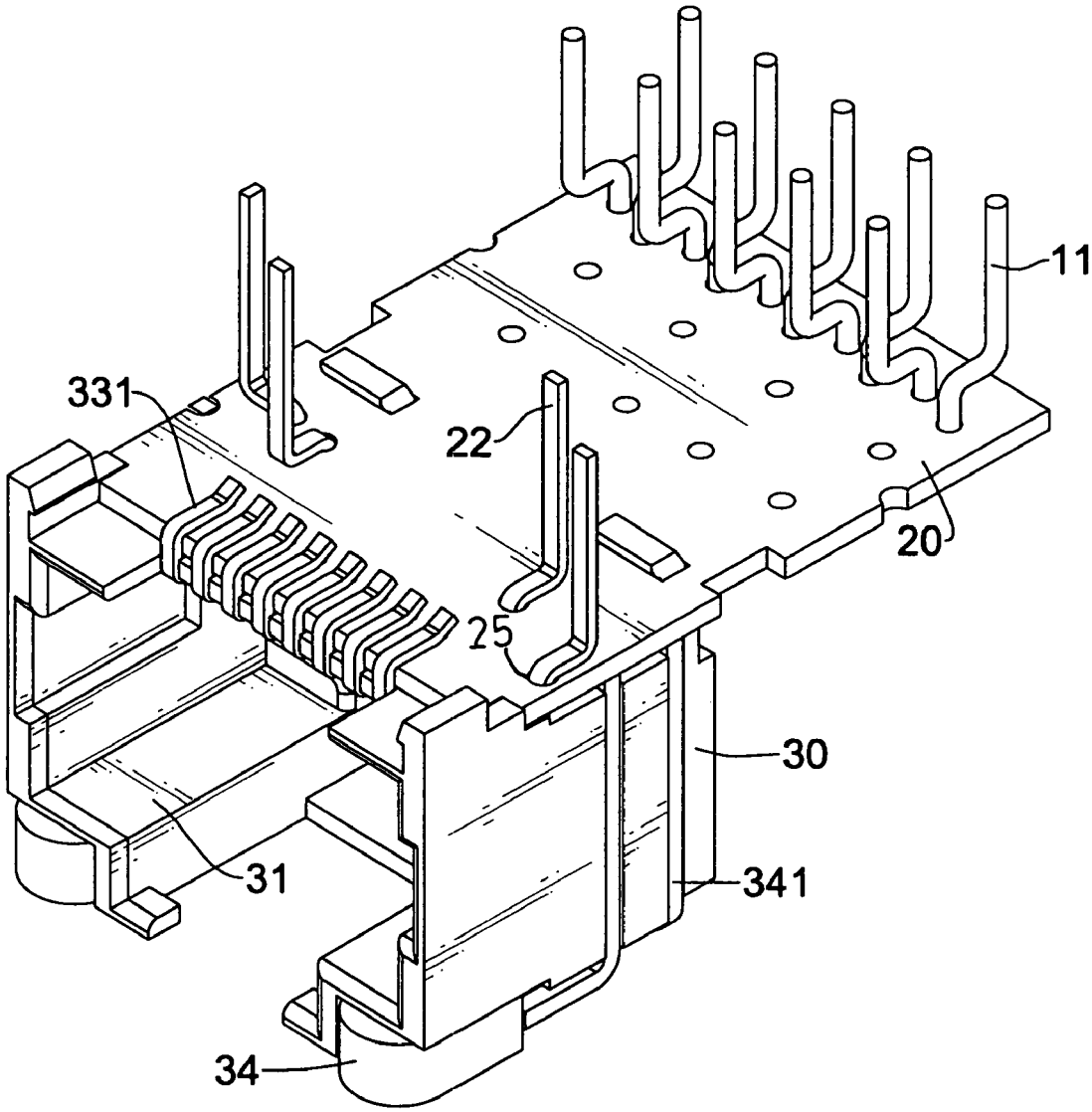
FIG. 5 is a bottom perspective view of the RJ-45 socket in FIG. 4 without a base and a cover.
Figure 6:
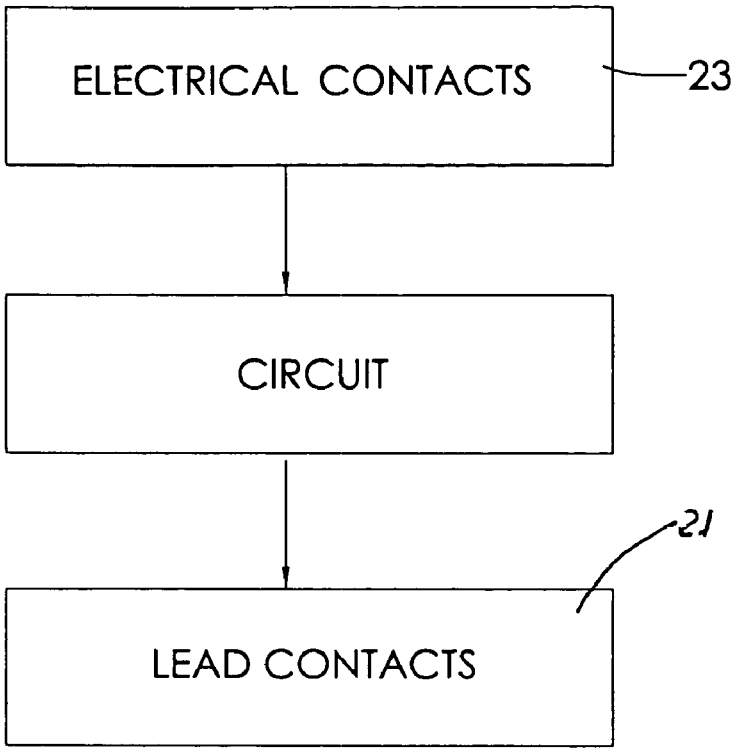
FIG. 6 is a flow chart of the electrical contacts electrically connects to the lead contacts.
Figure 7:
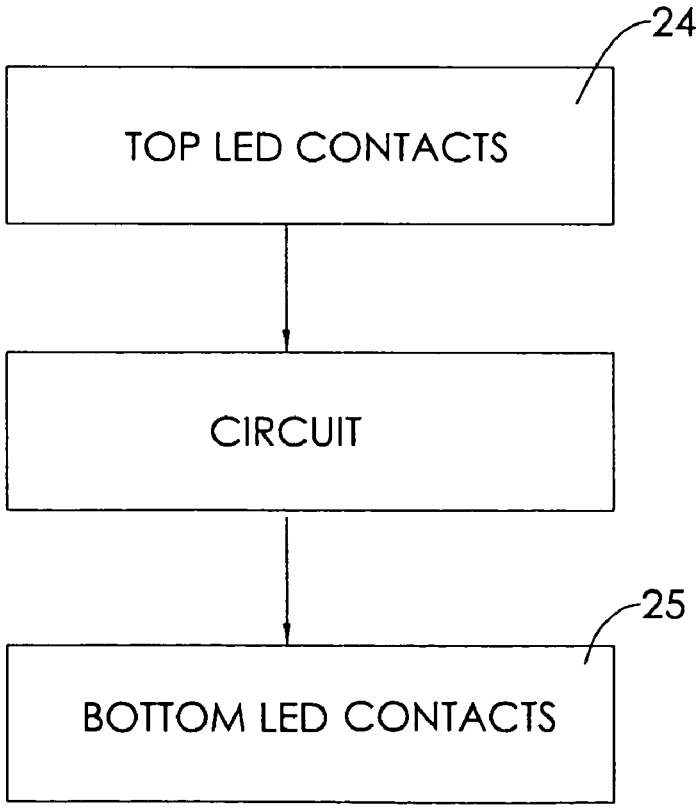
FIG. 7 is a flow chart of the top LED contacts electrically connects to the bottom LED contacts.

2. The circuit board to which the RJ-45 socket is connected has LED contacts. With reference to FIGS. 2 and 3, the leads (341) of the LEDs (34) extend through the circuit board (20) and the base (10) when the LED contacts on the other circuit board are aligned with the leads (341). With reference to FIGS. 4 and 5, the leads (341) connect to the top LED contacts (24) on the circuit board (20), and the LED extension leads (22) connect to the bottom LED contacts (25) on the circuit board (20) because the circuit in the circuit board (20) electrically connects the top LED contacts (24) respectively to the bottom LED contacts (25) when the LED contacts on the other circuit board are not aligned with the leads (341). Therefore, the leads (341) of the LEDs (34) do not has to be bent to connect to the corresponding LED contacts on the other circuit board.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An Rj-45 socket comprising
a base having
a top surface; and
multiple leads extending through the base;
a circuit board mounted on the top surface of the base and having
a bottom surface;
a top surface;
multiple lead contacts formed in the circuit board and connecting respectively to the leads in the base;
multiple electrical contacts formed in the circuit board; and
a circuit formed in the circuit board to electrically connect the electrical contacts respectively to lead contacts;
a casing mounted on the base above the circuit board and having
a front end;
a top;
a bottom;
two sides;
a cavity formed in the front end of the casing and having multiple notches formed in the cavity in the bottom of the casing;
two pairs of slots formed respectively in the sides of the casing from the top to the bottom;
a contact assembly mounted in the notches in the cavity and having multiple contacts mounted respectively in the notches and corresponding to and connecting respectively to the electrical contacts in the circuit board; and
two light-emitting diodes (LEDs) mounted on the top of the casing respectively near the sides, and each LED having two leads aligning respectively with the slots; and
a cover mounted securely on and covering the casing, the circuit board and the base.

2. The RJ-45 socket as claimed in claim 1, wherein the leads of the LEDs extend through the circuit board and the base.

3. The RJ-45 socket as claimed in claim 1, wherein
the circuit board further has
four top LED contacts formed in the top surface of the circuit board;
four bottom LED contacts formed in the bottom surface of the circuit board; and
four LED extension leads connecting respectively to the bottom LED contacts in the circuit board and extending through the base;
the leads of the LEDs are connected respectively to the top LED contacts in the circuit board; and
the circuit connects the top LED contacts on the top surface of the circuit board respectively to the bottom LED contacts.

4. The RJ-45 socket as claimed in claim 1, wherein
the base further has a rear end;
the leads in the base extend through the base near the rear end;
the circuit board further has
a rear end; and
a front end;
the lead contacts formed in the circuit board are formed near the rear end; and
the electrical contacts formed in the circuit board are formed near the front end.

5. The RJ-45 socket as claimed in claim 2, wherein
the base further has a rear end;
the leads in the base extend through the base near the rear end;
the circuit board further has
a rear end; and
a front end;
the lead contacts formed in the circuit board are formed near the rear end; and
the electrical contacts formed in the circuit board are formed near the front end.

6. The RJ-45 socket as claimed in claim 3, wherein
the base further has a rear end;
the leads in the base extend through the base near the rear end;
the circuit board further has
a rear end; and
a front end;
the lead contacts formed in the circuit board are formed near the rear end; and
the electrical contacts formed in the circuit board are formed near the front end.

* * * * *